US009616269B1

(12) United States Patent
Burosh

(10) Patent No.: US 9,616,269 B1
(45) Date of Patent: Apr. 11, 2017

(54) EXERCISE DEVICE

(71) Applicant: Matthew Patrick Burosh, St. Paul, MN (US)

(72) Inventor: Matthew Patrick Burosh, St. Paul, MN (US)

( * ) Notice: Subject to any disclaimer, the term of this patent is extended or adjusted under 35 U.S.C. 154(b) by 0 days.

(21) Appl. No.: 14/810,637

(22) Filed: Jul. 28, 2015

Related U.S. Application Data

(60) Provisional application No. 62/122,229, filed on Oct. 15, 2014.

(51) Int. Cl.

| | |
|---|---|
| ***A63B 21/06*** | (2006.01) |
| ***A63B 21/08*** | (2006.01) |
| ***A63B 21/078*** | (2006.01) |
| ***A63B 21/072*** | (2006.01) |
| ***A63B 21/075*** | (2006.01) |

(Continued)

(52) U.S. Cl.
CPC ..... *A63B 21/072* (2013.01); *A63B 21/0004* (2013.01); *A63B 21/06* (2013.01); *A63B 21/08* (2013.01); *A63B 21/4033* (2015.10); *A63B 21/4043* (2015.10)

(58) Field of Classification Search
CPC ... A63B 21/06; A63B 21/072; A63B 21/0722; A63B 21/075; A63B 21/00; A63B 21/0004; A63B 21/00043; A63B 21/0601; A63B 21/0604; A63B 21/0607; A63B 21/0608; A63B 21/0609; A63B 21/0615; A63B 21/0616; A63B 21/0617; A63B 21/0618; A63B 21/0724; A63B 21/0726; A63B 21/0728; A63B 21/078;

(Continued)

(56) References Cited

U.S. PATENT DOCUMENTS 4,978,122 A * 12/1990 Dibowski ..... A63B 21/0724 482/106
5,242,348 A * 9/1993 Bates ..... A63B 21/0004 482/105

(Continued)

FOREIGN PATENT DOCUMENTS

GB 2516269 A 1/2015
WO 2013181757 A2 12/2013

OTHER PUBLICATIONS

Dual Grip Medicine Ball, Century LLC. Believed available for purchase at least as Oct. 13, 2014. Retrieved from http://www.amazon.com/Century-Dual-Grip-Medicine-Ball/dp/B00EBXMZHI. 5 pages.

(Continued)

*Primary Examiner* — Joshua Lee
(74) *Attorney, Agent, or Firm* — Mueting, Raasch & Gebhardt, P.A.

(57) ABSTRACT

An exercise device for use with various exercises includes a body providing an exercise mass, a cavity formed in the body, a first handle for handling by a user extending radially outward from the body, and a second handle for handling by the user extending radially outward from the body. Various exercises may be performed by a user gripping one or both handles. The cavity is also sized and shaped to receive an exercise bar, such as a barbell bar or macebell bar, therethrough for performing additional exercises. The exercise device is optionally separated into a first portion including the first handle and a second portion including the second handle.

20 Claims, 11 Drawing Sheets

(51) Int. Cl.
*A63B 71/00* (2006.01)
*A63B 21/00* (2006.01)

(58) Field of Classification Search
CPC . A63B 21/08; A63B 21/4033; A63B 21/4035; A63B 21/4043
See application file for complete search history.

(56) References Cited

U.S. PATENT DOCUMENTS 5,692,996 A * 12/1997 Widerman ..... A63B 21/072 482/106
D406,183 S * 2/1999 Zovich ..... D21/680
6,190,292 B1 * 2/2001 Panes ..... A63B 21/06 482/109
6,746,380 B2 * 6/2004 Lien ..... A63B 21/06 482/106
7,198,591 B2 * 4/2007 Lien ..... A63B 21/0728 482/106
7,942,792 B1 * 5/2011 Wyman ..... A63B 21/0601 482/107
D651,262 S 12/2011 Kabbani-Crawford et al.
D659,204 S 5/2012 Cotter
8,454,483 B1 * 6/2013 Bradley ..... A63B 21/072 482/44
8,568,280 B2 10/2013 Mendoza
8,882,642 B2 11/2014 Chavez et al.
8,911,334 B1 12/2014 Cotter et al.
8,944,971 B2 * 2/2015 Shorter ..... A63B 21/075 482/107
D726,264 S 4/2015 Agate et al.
9,216,315 B1 * 12/2015 Chang ..... A63B 21/075
9,364,704 B1 * 6/2016 Kuka ..... A63B 21/0726
2001/0001094 A1 5/2001 Panes
2004/0077466 A1 * 4/2004 Wallace ..... A63B 21/072 482/93
2006/0003874 A1 * 1/2006 Hamilton ..... A63B 21/06 482/93
2011/0263393 A1 * 10/2011 Ross ..... A63B 21/072 482/93
2012/0046148 A1 * 2/2012 Aguila ..... A63B 21/072 482/93
2012/0053024 A1 * 3/2012 Mendoza ..... A63B 21/072 482/106
2012/0157270 A1 * 6/2012 Johnson ..... A63B 21/075 482/93
2012/0172182 A1 * 7/2012 Leier ..... A63B 21/072 482/108
2012/0184418 A1 * 7/2012 Wilson ..... A63B 21/00043 482/112
2012/0309595 A1 12/2012 Dike
2013/0267390 A1 * 10/2013 Warren ..... A63B 21/0602 482/93
2014/0024507 A1 * 1/2014 Hagos ..... A63B 21/0726 482/108
2014/0141944 A1 * 5/2014 Johnson ..... A63B 21/072 482/93
2016/0030797 A1 * 2/2016 Erickson ..... A63B 21/00058 482/132

OTHER PUBLICATIONS

Dual Grip Xerball Medicine Ball, SPRI Products, Inc. Believed available for purchase at least as of Oct. 13, 2014. Retrieved from http://www.amazon.com/gp/product/B008804R1M/ref=pd_lpo_sbs_dp_ss_3?pf_rd_p=1944687522&pf_rd_s=lpo-top-stripe-1&pf_rd_t=201&pf_rd_i=B002HYQRK4&pf_rd_m=ATVPDKIKX0DER&pf_rd_r=1A5X6PW8S1AJDXF5KZGD. 5 pages.
Economy Cast Iron Kettlebell with Rubber Base in Kilograms, Kamparts, Inc. Believed available for purchase at least as of Jun. 25, 2015. Retrieved from http://www.ironcompany.com/economy-kettlebell-rubber-base.aspx. 3 pages.
Gold's Gym 5lb Open Handle Hammertone KettlePlate. Believed available for purchase at least as of Oct. 13, 2014. Retrieved from http://www.getgoldsgym.com/fitness/en/GetGoldsGym/Strength/golds-gym-5-lb-open-handle-hammertone-kettleplate. 2 pages.
My Space Tyre, Gym Friendly, Multi User Big Tyre Training, Tyre Workouts and Exercises. Published on Aug. 6, 2013. Retrieved from https://www.youtube.com/watch?v=-bOHGIBAWp8. 1 page.
ParadigmPro Steel Competition Kettlebells, KB USA Fitness Products LLC. Believed available for purchase at least as of Oct. 13, 2014. Retrieved from: http://www.kettlebellsusa.com/kettlebells_usa_paradigm_pro_steel_competition_kettlebells_best_kettlebells.html. 3 pages.
TIYR, Escape Fitness. Believed available for purchase at least as of Oct. 13, 2014. Retrieved from http://www.escapefitness.com/uk/new-products/tiyr. 2 pages
Trans4mer, PWS: Progressive Weight System, GoXercise, Inc. Believed available for purchase at least as of Oct. 13, 2014. Retrieved from http://www.goxercise.com/2.html. 1 page.

* cited by examiner

EXERCISE DEVICE

CROSS-REFERENCE TO RELATED APPLICATION

This application claims the benefit of Provisional Application No. 62/122,229, filed Oct. 15, 2014, which is herein incorporated by reference in its entirety.

TECHNICAL FIELD

The present disclosure relates to an exercise device. In particular, the present disclosure relates to an exercise device providing a weight configured for one- or two-handed use and optionally attachable to complementary equipment.

BACKGROUND

Various exercise devices provide a mass or weight for exercise and are also specialized for particular exercises while not being well-suited for other exercises. For example, the kettlebell has a weight and a single handle, which is amenable to exercises involving swinging a weight but is not well-suited for a bench press. As another example, a barbell including attached weight plates (e.g., Gold's Gym Open Handle Hammertone KettlePlates) is amenable to squats or bench presses at a variety of selected weights, but neither the barbell nor the individual weight plates are well suited for being swung at heavier weights due to their bulky shape. Similarly, a medicine ball having one or more handles does not facilitate swinging like a kettle bell, such as the Century Dual Grip Medicine Ball. When a user desires to perform a variety of exercises, often a variety of devices are desired to be used. Each specialized exercise device has an associated cost and takes up storage space, which can be difficult for a user on a limited budget who desires to perform a variety of exercises or for a workout location where storage space is limited.

SUMMARY

Various aspects of the present disclosure relate to an exercise device. The exercise device comprises a body providing an exercise mass having a first height along an axis. An optional cavity is formed in the body. A first handle for handling by a user extends radially outward from the body, and a second handle for handling by the user extends radially outward from the body. At least one handle of the first and second handles is aligned along a plane perpendicular to the axis and parallel to a surface. The at least one handle has a second height along the axis that is less than the first height of the body to provide a clearance between the heights for a user to grip the at least one handle when the body is positioned adjacent to the surface.

Additional aspects of the present disclosure relate to an exercise device comprising a body providing an exercise mass, a first handle for handling by a user extending radially outward from the body, and a second handle for handling by the user extending radially outward from the body. The first and second handles are aligned along a plane. At least one of the first and second handles has a first length, and the exercise device has an overall length, the first length being about one-third of the overall length.

Some aspects relate to methods of using the exercise device. One method comprises providing an exercise device including a body, a cavity extending through the body, a first handle extending radially outward from the body, and a second handle extending radially outward from the body, the exercise device providing an exercise mass. The method further comprises sliding a bar into the cavity of the exercise device, gripping at least one of the first and second handles, and moving the exercise device and the bar via at least one of the first and second handles to perform an exercise with the weight provided by the bar and the exercise device.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
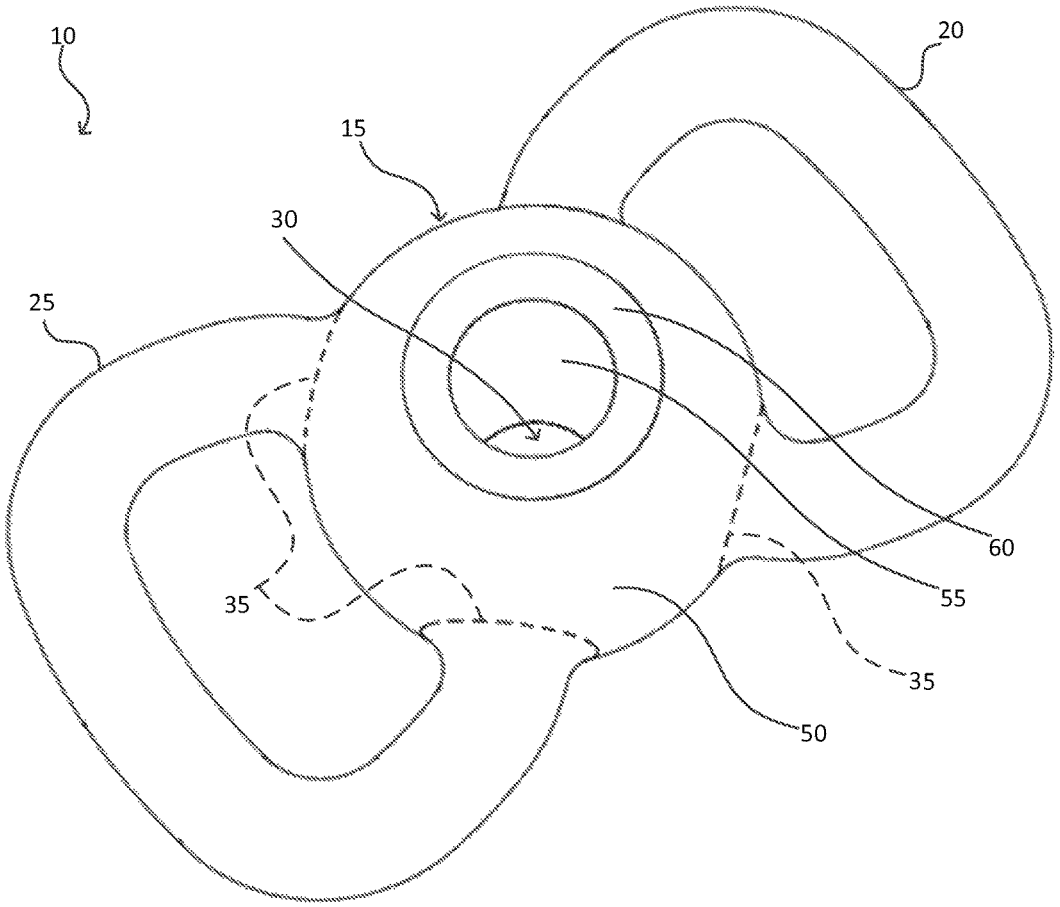
FIG. 1 is an overhead perspective view of an exercise device, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 2:
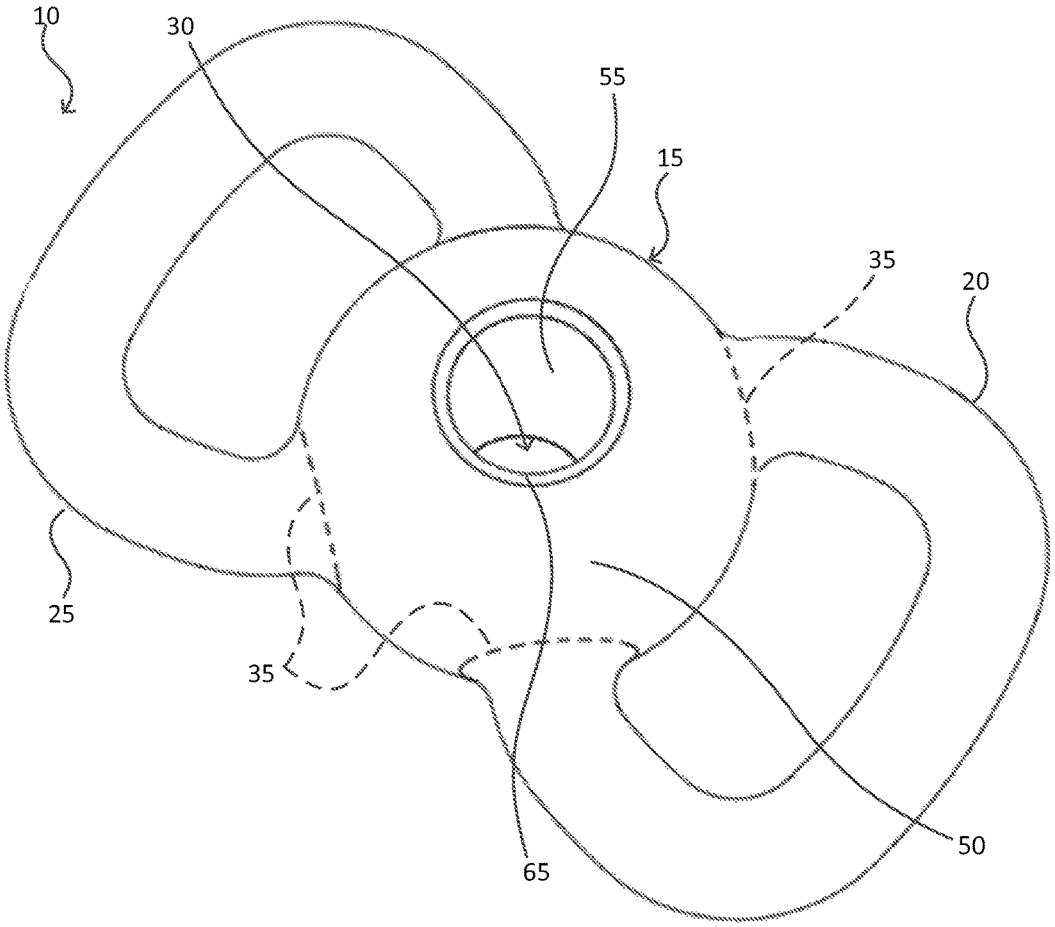
FIG. 2 is an underside perspective view of the exercise device of FIG. 1, according to some embodiments.

FIGS. 1 and 2 are overhead and underside perspective views, respectively, of an exercise device 10 including a body 15, a first handle 20 extending radially outward from the body, and a second handle 25 extending radially outward from the body. The illustrated exercise device 10 is well-suited a variety of exercises that would typically involve more than one exercise device. The handles 20, 25 are sized and shaped to be handled or gripped by one or more hands of a user and the body 15 is also sized and shaped accordingly for various exercises, such as swinging the exercise device 10. Additional and non-limiting examples of exercises for use with the exercise device 10 are described herein elsewhere with respect to FIGS. 10-13, for example. In some embodiments, an optional cavity 30 is also formed in the body. The cavity 30 may be used for various additional exercises, which may include complementary exercise equipment that interacts with the cavity.

The exercise device 10 has an overall mass that may be selected from a variety of masses or weights, generally measured in pounds (lb) or kilograms (kg). An appropriate mass or weight for each exercise device 10 can be selected for certain exercises, body types, or standard weight set values, for example.

The body 15 provides a part of the overall mass. In various embodiments, the body 15 is a solid piece of material that is not hollow other than the cavity 30 formed therein. Examples of materials for the body 15 include iron, steel, an alloy, a plastic, a compound material, or another material or combination thereof for providing a rigid mass suitable for exercise. The body 15 is rigidly formed in various embodiments. In some embodiments, the mass of the body 15 is evenly distributed. In other embodiments, the mass of the body 15 is not evenly distributed and may be biased to one side of center. In additional embodiments (not shown), the body 15 has one or more hollow pockets formed therein to modify the mass of the exercise device 10 without changing the volumetric size or shape of the device, which are optionally inaccessible or sealed within the body 15 and/or handles 20, 25.

Figure 5:
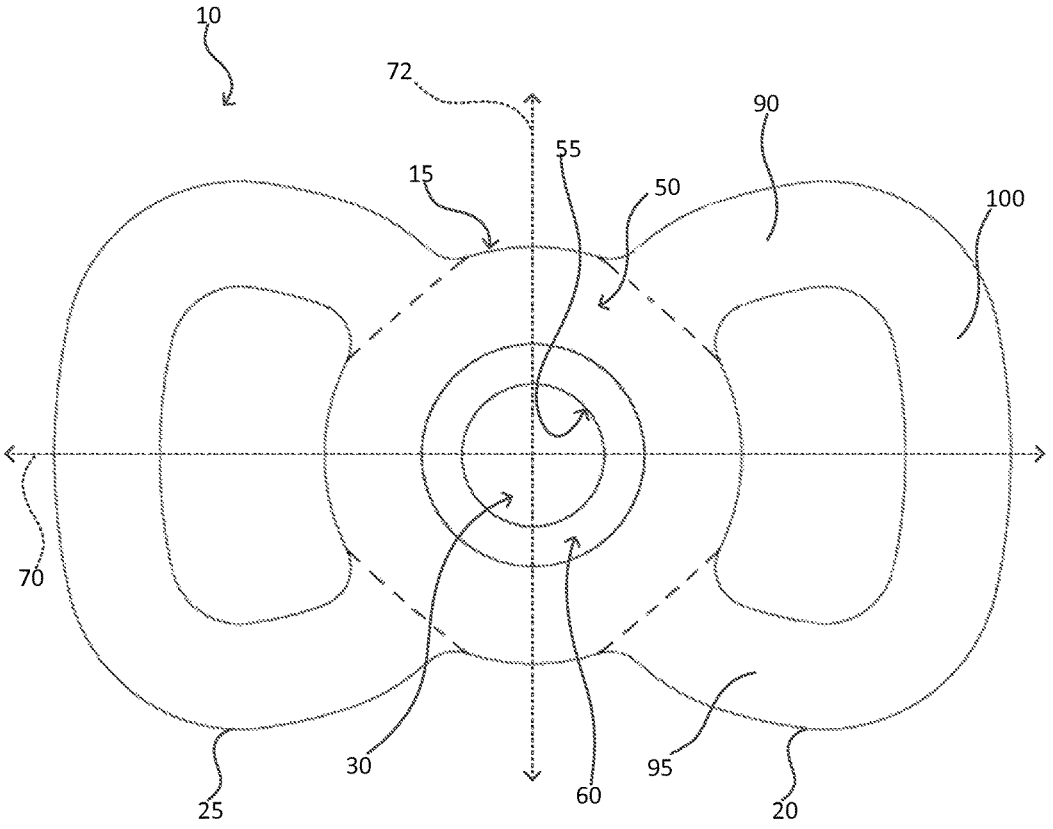
FIG. 5 is an overhead view of the exercise device of FIG. 1, according to some embodiments.
Figure 6:
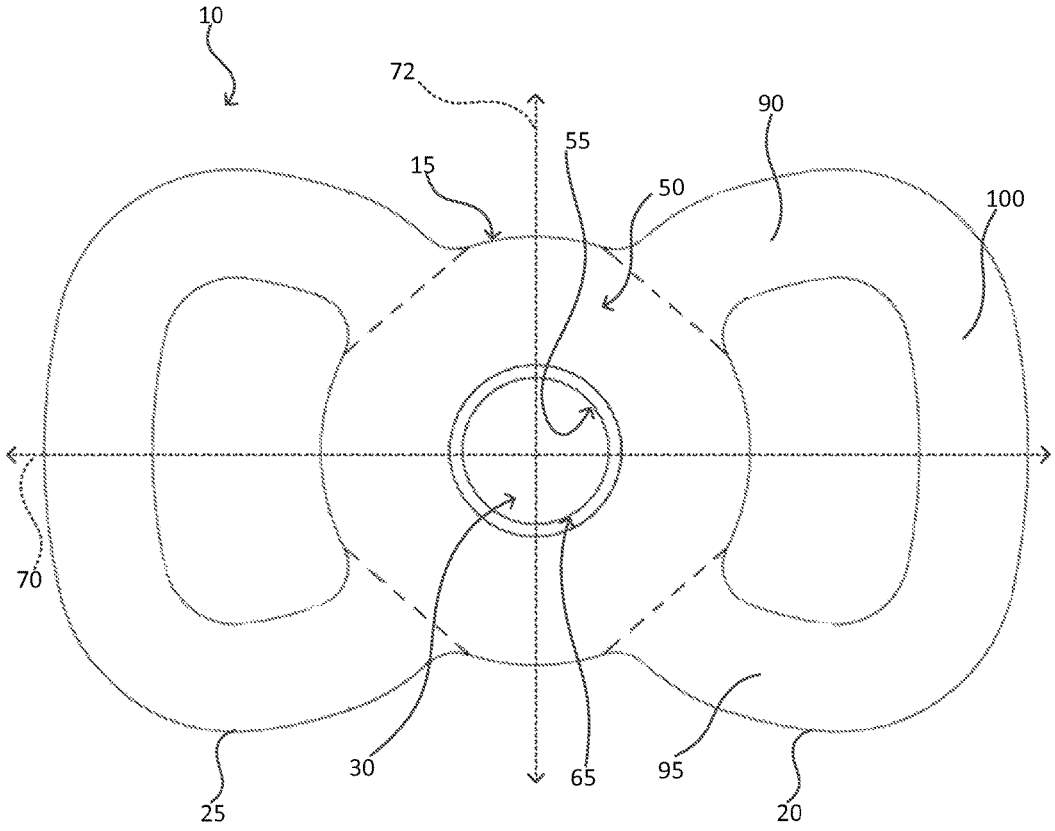
FIG. 6 is an underside view of the exercise device of FIG. 1, according to some embodiments.

The handles 20, 25 also form a part of the overall mass. In various embodiments, the handles 20, 25 are positioned on opposite sides of the body 15 (e.g., 180 degrees). As shown, the first handle 20 is directly opposite the second handle 25 and each handle is attached at different positions of the body 15. In other embodiments (not shown), the handles 20, 25 are aligned at other positions relative to the body 15, such as 10 o'clock and 2 o'clock (e.g., 120 degrees). In the illustrated embodiment, the handles 20, 25 have a loop shape, which is described herein elsewhere in more detail (FIGS. 5-6). In some embodiments, the handles 20, 25 are rigidly formed. In various embodiments, one or more of the handles 20, 25 are formed of the same material as the body 15. In some further embodiments, each handle 20, 25 is formed of the same material. However, in yet other embodiments, one or more of the handles 20, 25 are formed of different materials than the body 15.

In some embodiments, one or more of the handles 20, 25 is selected to be the mass or weight of the material missing from the body 15 due to the presence of the cavity 30 formed therein. In various embodiments, the body 15 of the exercise device 10 is also similar to the body of a kettle bell of a similar weight, which may improve the ability of a user to select an exercise device 10 having a desired weight when the user is accustomed to kettle bells or when exercise devices 10 are stored with kettle bells on the same rack.

Demarcation lines 35 are illustrated to show an example of boundaries between the handles 20, 25 and the body 15. However, in the illustrated embodiment, the handles are integrally formed with the body 15 and no actual lines between the handles 20, 25 and the body 15 are visible. The integrally formed handles facilitate the ease of manufacturing. In one example, the body 15 and the handles 20, 25 are formed in a single mold, cast, or other technique for forming an integrated exercise device 10. In some embodiments, the handles 20, 25 are rigidly attached to the body 15 so that the handles do not move with respect to the body 15, for example, when being used.

In other embodiments (not shown), one or more handles 20, 25 are separately formed from the body 15 and are coupled to or attached, either permanently (e.g., welded) or removably (e.g., by a fastener, such as a pin-type or a screw-type). A separately formed handle can facilitate the ease of manufacturing or the ability to customize the exercise device 10 for various exercises. In one example, a plurality of handles 20, 25 are fabricated in various sizes and each is configured to attach to one or more bodies 15, which may also be of various sizes.

As illustrated, the cavity 30 extends inwardly from a surface of the body 15. In some embodiments, the cavity 30 is in the form of a lumen or defines an elongated space, such as a cylinder. Also, as illustrated, the cavity 30 extends completely through the body 15, from one side of the body to another, and allows an object to be placed through the body 15 of the exercise device 10, such as another piece of exercise equipment. The equipment may also be fastened to the body 15. The equipment and the exercise device 10 may be used together for a variety of exercises, which may expand the potential exercises with the exercise device 10. Various non-limiting examples of equipment used with the exercise device 10 include a bar (e.g., barbell- or macebell-type) described herein elsewhere with respect to FIGS. 7-8.

In some embodiments (not shown), the cavity 30 extends partially through the body 15, from one side of the body, such that the height of the cavity 30 is less than the overall height of the exercise device 10. For example, the exercise device 10 may include a cavity 30 having threads or a pin allowing a macebell bar or other bar to be fastened or secured to the exercise device 10 for use with a swinging exercise and/or to work on grip development.

In various embodiments (not shown), the cavity 30 is open to a third side allowing a piece of exercise equipment to be introduced into the elongated portion of the cavity in a sideways manner, and the cavity optionally includes a recess portion.

In the illustrated embodiment, the body 15 is generally in the shape of a ball having selectively flattened surfaces near the cavity 30. As shown, the body 15 includes an outer surface 50, an inner surface 55 exposed to the cavity 30, a first surface 60 between the outer surface and the inner surface (FIG. 1), and a second surface 65 between the outer surface and the inner surface (FIG. 2). The outer surface 50 is generally convex. The surfaces 60, 65 define cutaway boundaries of the ball-shaped body 15 to facilitate use of the exercise device 10 adjacent to a surface. In the illustrated embodiment, the first surface 60 has a greater surface area than the second surface 65. In other embodiments (not shown), the second surface 65 has a greater surface area than the first surface 60 or surfaces 60, 65 are the same size.

As illustrated, the surfaces 60, 65 are generally flat and shorten the height of the cavity 30 and the overall height of the body 15 of the exercise device 10 (e.g., by 10%, 20%, or any other suitable amount) when compared to a similar body without the surfaces 60, 65 (shown in broken lines). Various non-limiting examples of uses for the surfaces 60, 65 include: placement of the exercise device 10 on a flat surface for storage or use, the placement of the exercise device when being used with an object positioned in the cavity 30, and the stacking of one or more exercise devices on an object for exercise with a greater total weight. The surfaces 60, 65 may have a curvature that is flatter than the convex shape of the outer surface 50 or any other form suitable for the exemplary uses described. In some embodiments, the transitions between the surfaces 60, 65 with the outer and inner surfaces 50, 55 are gradual and lack sharp edges to improve ergonomics. In various embodiments, a bevel is included along the transitions between the surfaces.

Other shapes of the body 15 and the outer surface 50 thereof are contemplated, such as, without limitation, a ball, a sphere, an oval or egg shape, a cuboid (e.g., rectangular or square), an octagon (e.g., 8 surfaces), a hexagon (e.g., 6, surfaces), a pentagon (e.g., 5 surfaces), a triangle (e.g., 3 surfaces), a cylinder, symmetric or asymmetric variations thereof, variations thereof including a three-dimensional design (e.g., animal head, skull, zombie head, etc.), and variations thereof including one or more flattened surfaces. A person having skill in the art and having the benefit of the disclosure would be able to select an appropriate shape for the body 15 for a particular application, such as a specific exercise.

In various embodiments (not shown), the body 15 or one or more handles 20, 25 are partially or fully covered by a cover material. In some cases, the cover material is selected to protect the exercise device 10 from damage (e.g., contact with other equipment), to increase frictional grip between the exercise device and the user or a surface, or to provide the user a softer-touch material for interacting with the exercise device or increasing grip. The cover material may be formed of polyvinyl chloride (PVC), rubber, leather, plastic, neoprene, a non-metallic substance, or another suitable material or combinations thereof, having a protective or improved frictional property, for example.

Figure 3:
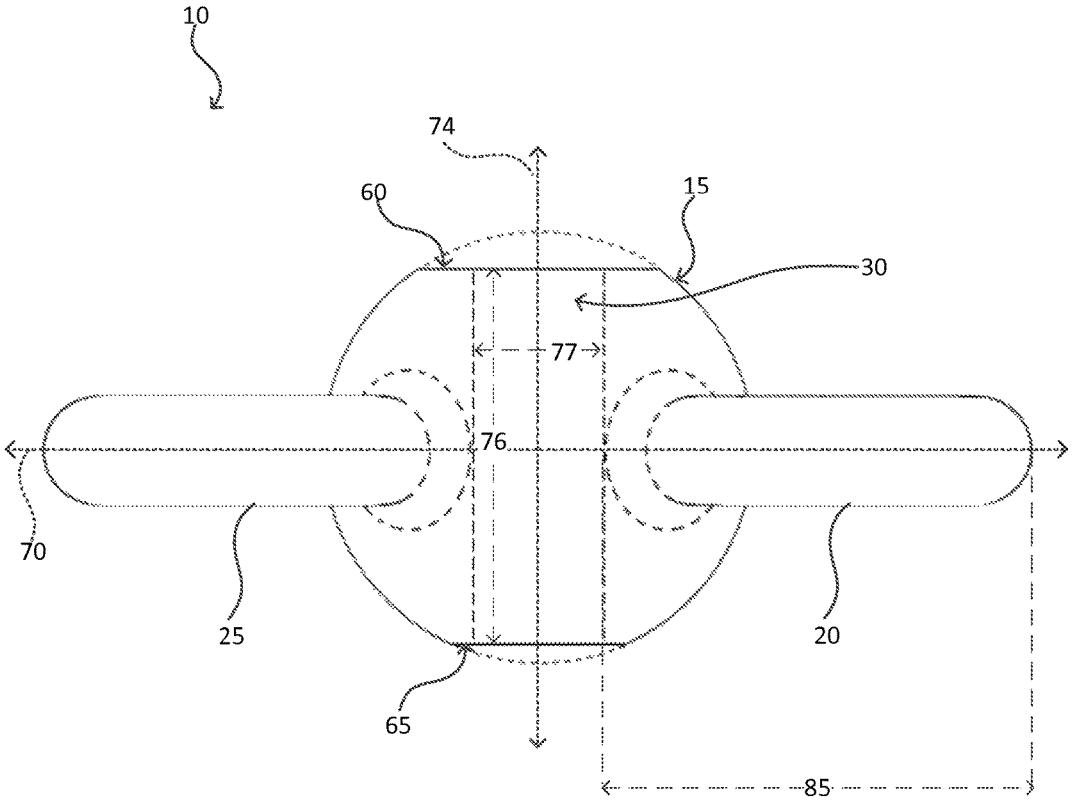
FIG. 3 is an elevation view of the exercise device of FIG. 1, according to some embodiments.
Figure 4:
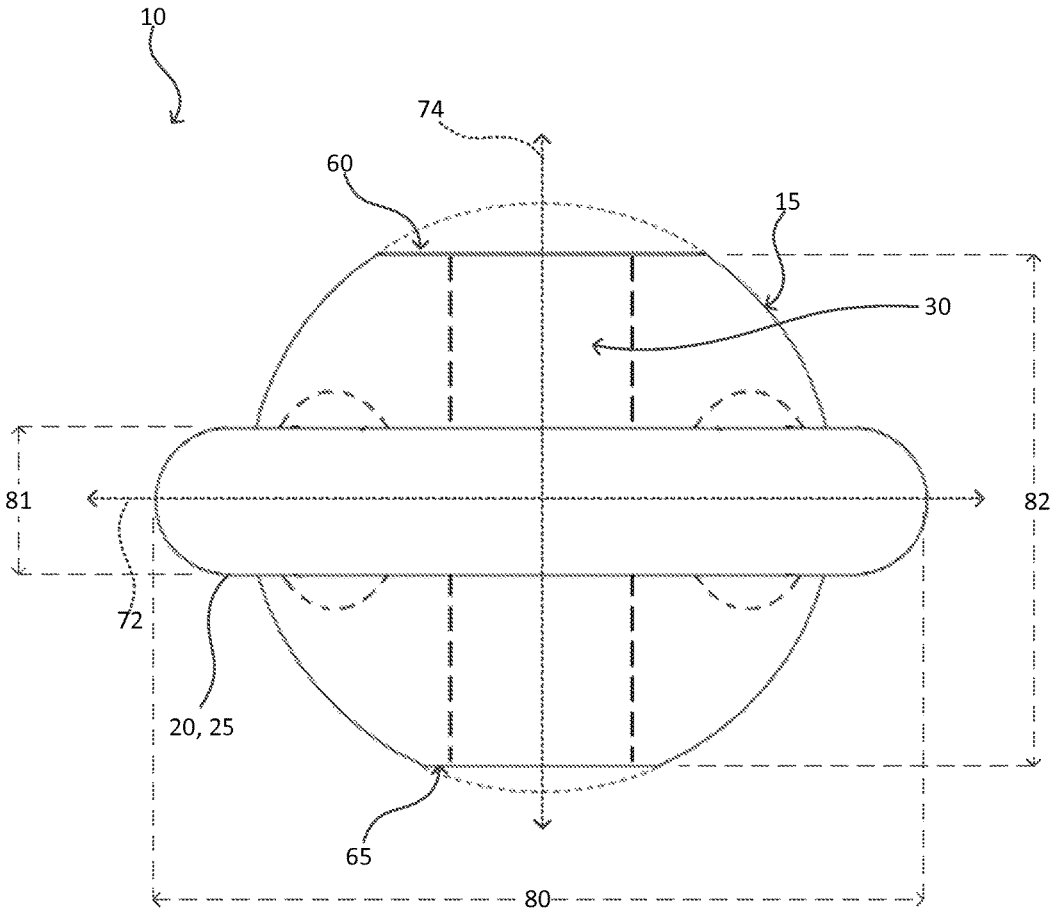
FIG. 4 is another elevation view of the exercise device of FIG. 1, according to some embodiments.

FIGS. 3-6 are various views of the exercise device 10 aligned to imaginary axes, including a first axis 70, a second axis 72, and a third axis 74, according to some embodiments. The axes 70, 72, 74 are orthogonal (e.g., perpendicular), to each other and define a Cartesian space (e.g., an X-axis, a Y-axis, and a Z-axis, respectively). The axes 70, 72, and 74 together also define one or more planes, such as the X-Y plane, the X-Z plane, and the Y-Z plane. In particular, FIG. 3 is an elevation view in the X-Z plane (e.g., a long side view), and FIG. 4 is an elevation view in the Y-Z plane (e.g., a short side, end view). FIGS. 5-6 are overhead and underside views, respectively, in the X-Y plane.

As illustrated, the intersection of the axes 70, 72, 74 is positioned at the center of the exercise device 10, the body 15, and the cavity 30 for a neutrally biased exercise device, which may be suitable for certain exercises benefitting from the mass being balanced between the hands of a user. In other embodiments (not shown), the body 15, the cavity 30, and the handles 20, 25 may be aligned or positioned in various arrangements, some of which are described herein in more detail.

As illustrated, the exercise device 10 and its components, such as the body 15, each handle 20, 25, and the cavity 30, exhibit a reflectional symmetry across the X-Y plane. The handles 20, 25, as shown, are positioned as mirror images of each other across the Y-Z plane and each exhibit reflectional symmetry across the X-Y plane. Also, as illustrated, the body 15 and the cavity 30 exhibit a rotational symmetry about the axis 74. In other embodiments (not shown), the exercise device 10, the body 15, the handles 20, 25, and/or the cavity 30 do not exhibit symmetry.

The term "aligned" as used herein may refer to the center, a line through the center, a plane through the center, or a three-dimensional space about the center of an object intersecting with one or more of the center, a line through the center, a plane through the center, or a three-dimensional space about the center of another object, for example. The "center" of an object may refer to a volumetric center or a center of mass (e.g., center of gravity), for example.

As shown, the center of the cavity 30 is aligned with the center of the exercise device 10. Perhaps as best shown in FIG. 4, the center of the cavity 30 is aligned to the third axis 74. In other embodiments (not shown), the center of the cavity 30 is not aligned with the center of the body 15 of the exercise device 10 (e.g., off center) to bias the body 15 to a particular side. In some cases, a piece of equipment, such as a barbell bar, horizontally positioned in the off-center cavity 30 will rotate the exercise device 10 to a favored orientation due to gravity or due to momentum during use.

Perhaps as best shown in FIG. 3, the center of the handles 20, 25 in the illustrated embodiment is positioned in both the X-Y plane and X-Z plane. In the illustrated embodiment, the cavity 30 has a height 76 (FIG. 3) aligned in parallel to the third axis 74 and a diameter 77 (FIG. 3) aligned in parallel to the X-Y plane. In some instances, the cavity 30 defines a passage along the height 76 through which a piece of equipment travels along the third axis 74 to be positioned in the cavity 30 for use with the exercise device 10. For example, the diameter 77 of the cavity 30 may be configured to fit a standard barbell bar weight-loading extension therethrough, which may also include a special insert to improve pivoting between the extension and the exercise device 10.

In the illustrated embodiment, the first handle 20 has a width 80 (FIG. 4) aligned in parallel to the second axis 72, a height 81 aligned in parallel to the third axis 74 (FIG. 4), and a length 85 (FIG. 3) aligned in parallel to the first axis 70. In some embodiments, the height 81 is also the cross-sectional diameter of the first handle 20. As shown, the height 81, or diameter, of the first handle 20 is generally constant in a gripping portion separate from an attachment portion adjacent to the body 15. The second handle 25, as illustrated, has similar characteristics. However, in other embodiments (not shown), the second handle 25 differs in length and width from the first handle 20 to accommodate various exercises.

As shown, the body 15 of the exercise device 10 has a height 82 (FIG. 4), which is equal to the height 76 of the cavity 30 (FIG. 3). However, in other embodiments, the height 82 (FIG. 4) is greater than the height 76.

In various embodiments, the height 81 is a fraction of the height 82. As illustrated, the height 81 of the first handle 20 is aligned with and less than the height 82 of the body 15 to provide a clearance for the user to grip the first handle 20 between the heights 81, 82. In various embodiments, the second handle 25 is similarly configured to provide a clearance. Clearance facilitates gripping the handles 20, 25, for example, when the exercise device 10 is placed on a surface (e.g., floor) to do an exercise (e.g., pushups) without trapping the user's fingers between the handles and the surface. In some embodiments, the clearance is about 1 inch or 2 inches, for example. In various embodiments, the height 81 is about one-half, about one-third, or less than about one-third of the height 82.

The alignment of the cavity 30, the first handle 20, and the second handle 25 may be set or selected for a desired relationship between the grip of the user and a piece of equipment positioned in the cavity 30, for example. Perhaps as best shown in FIG. 3, the height 76 of the cavity 30 is aligned with the third axis 74 and is perpendicular to the width 80 of the first handle 20.

In other embodiments (not shown), the height 76 of the cavity 30 is not aligned to the axis 74 and is not perpendicular to the width 80 of the first handle 20. In some cases, the height 76 of the cavity 30 is parallel to the width 80 of the first handle 20. Various other alignments among the cavity 30, the first handle 20, and the second handle 25 are contemplated.

In some embodiments, the alignment between the handles 20, 25 and the body 15 is set or selected in response to a desired relationship between the body 15 and the user. As illustrated, the body 15 is positioned between the handles 20, 25 and the handles are aligned along the first axis 70 and aligned with the X-Y plane. When the user uses a hand to grip each of the handles 20, 25 of the exercise device 10, the mass of the body 15 is generally placed between the hands of the user.

Various other alignments are contemplated that do not place the mass of the body 15 between the hands of the user. For example, in other embodiments (not shown), only one of the handles 20, 25 is aligned along the first axis 70. In yet other embodiments (not shown), the handles 20, 25 are not aligned along the first axis 70 but are aligned with the X-Y plane (e.g., like mouse ears). In various other embodiments (not shown), the handles 20, 25 are not aligned along the X-Y plane to bias the mass of the exercise device 10 to a particular side when gripped by a user.

Perhaps as best shown in FIGS. 5 and 6, in the embodiment as shown, the first surface 60 (FIGS. 3-5) of the body 15 is positioned adjacent to the cavity 30 between the outer surface 50 and the inner surface 55 of the body. Also, as shown, the second surface 65 (FIGS. 3-4, 6) of the body 15 is positioned adjacent to the cavity 30 between the outer surface 50 and the inner surface 55. As illustrated, the first surface 60 is positioned on the opposite side of the body 15 from the second surface 65. However, the first and second surfaces 60, 65 may be formed at other positions on the body 15.

The illustrated surfaces 60, 65 are flat to facilitate placement adjacent other flat objects (e.g., the ground). In other embodiments (not shown), one or more of the surfaces 60, 65 are concave to at least partially receive an object larger than the diameter 77 of the cavity 30. For example, a concave first surface 60 may be similar to a groove that facilitates placement of the exercise device 10 over or under a bar with the bar being at least partially nestled by the concave surface to restrict movement (e.g., prevent slipping) of the bar relative to the exercise device in one or more directions, which may be useful in utilizing the handles 20, 25 of the exercise device 10 for pull-ups in some instances. In yet other embodiments (not shown), one or more grooves are formed in the body 15 separate from the first surface 60 and/or not adjacent to the cavity 30.

In some embodiments, the first section 90 and second section 95 extend outwardly from or are attached to different positions on the body 15. Perhaps as best shown in FIG. 5, the handle 20 is attached to the body 15 at about 45 degrees (e.g. first position) and 315 degrees (e.g., second position) in the X-Y plane. The distance between those positions are parallel to the handle width 80. In various embodiments, the handle 25 extends outwardly from or is attached to different positions on the body 15 than handle 20. For example, the handle 25 is attached to the body 15 at about 135 degrees (e.g, third position) and 225 degrees (e.g., fourth position) in the X-Y plane.

As shown, the handles 20, 25 are structured for a user to grip the handles along to the handle width 80 (such that the knuckles are aligned with the handle width), which is orthogonal to the height 81 and the length 85. In the illustrated embodiment, perhaps as best shown in FIGS. 5 and 6, the first handle 20 is formed to include a first section 90 extending from the body 15, a second section 95 extending from the body 15, and a third section 100 between the first section 90 and the second section 95 and being spaced apart from the body to provide a generally quadrilateral loop.

In various embodiments, the third section 100 is spaced apart from the body 15 so that a one-handed snatch exercise can be performed and the knuckles of the user's hand can pass through the loop. In some cases, for example, when the user's hand is extended upwardly during the one-handed snatch exercise, the user advantageously does not have to bend his or her wrist in order to support the body 15 of the exercise device 10 along the back of the user's wrist or forearm.

In some embodiments, any of the sections 90, 95, 100 are configured in size and shape to provide locations for the user to ergonomically grip the exercise device 10 (e.g., no sharp edges where gripped, appropriate thickness, etc.) along one or more of the sections. As illustrated, the first section 90 and the second section 95 are generally parallel to each other, and the third section 100 is generally perpendicular thereto for handling or gripping by the user (e.g., part of the gripping portion). However, parts of the first section 90 and the second section 95 may also be handled or gripped by the user (e.g., part of the gripping portion). The sections 90, 95 are somewhat closer in distance near to the body and greater in distance away from the body such that the first and second sections taper inwardly toward the body. As further shown, one or more sections of the quadrilateral loop have a curvature. The second handle 25, as illustrated, is similarly formed as the first handle 20. However, in other embodiments (not shown), the second handle 25 differs in shape.

In other embodiments (not shown), the handles 20, 25 exclude either the first or second sections 90, 95 to form a hook instead of a loop. In yet other embodiments (not shown), the handles 20, 25 may form an annular loop or any other shape suitable for gripping or handling by the user. Although the handles 20, 25 may be configured in various forms, the handles 20, 25 are configured to be gripped and handled by the user to manipulate the exercise device 10.

In the illustrated embodiment, the width of the handles 20, 25 define the overall width of the exercise device 10, as the corresponding width of the body 15 is less than the handles' width. This relationship facilitates a focused center of gravity when swinging the exercise device 10 when gripped by a handle 20, 25. Also as illustrated, the height 82 of the body defines the overall height of the exercise device, as the corresponding heights of the handles are less than the body's height. This facilitates the ability of the user to grip each handle 20, 25 in a natural position and use the exercise device 10 adjacent to a surface (e.g., for a pushup) without placing undesirable stress on the user's fingers or hands. Furthermore, the length of the handles place the mass of the body 15 away from a typical gripping spot (e.g., the third section 100 on the first handle 20), which facilitates an appropriate distance for swinging the weight similar to a traditional kettlebell. For example, when swinging the exercise device 10 in various exercises, it is sometimes desirable for the inertia of the body 15 to rotate the exercise device 10 in the grip of the user. As shown, the length of the handles are about one-third of the overall length of the exercise device 10, with the length of the body 15 being about one-third of the overall length, to form a desirable swing with the exercise device. In this manner, the exercise device 10 facilitates easy use as a traditional kettle for swinging, while also being adaptable for easy use in other exercises, some of which are herein described.

Figure 7:
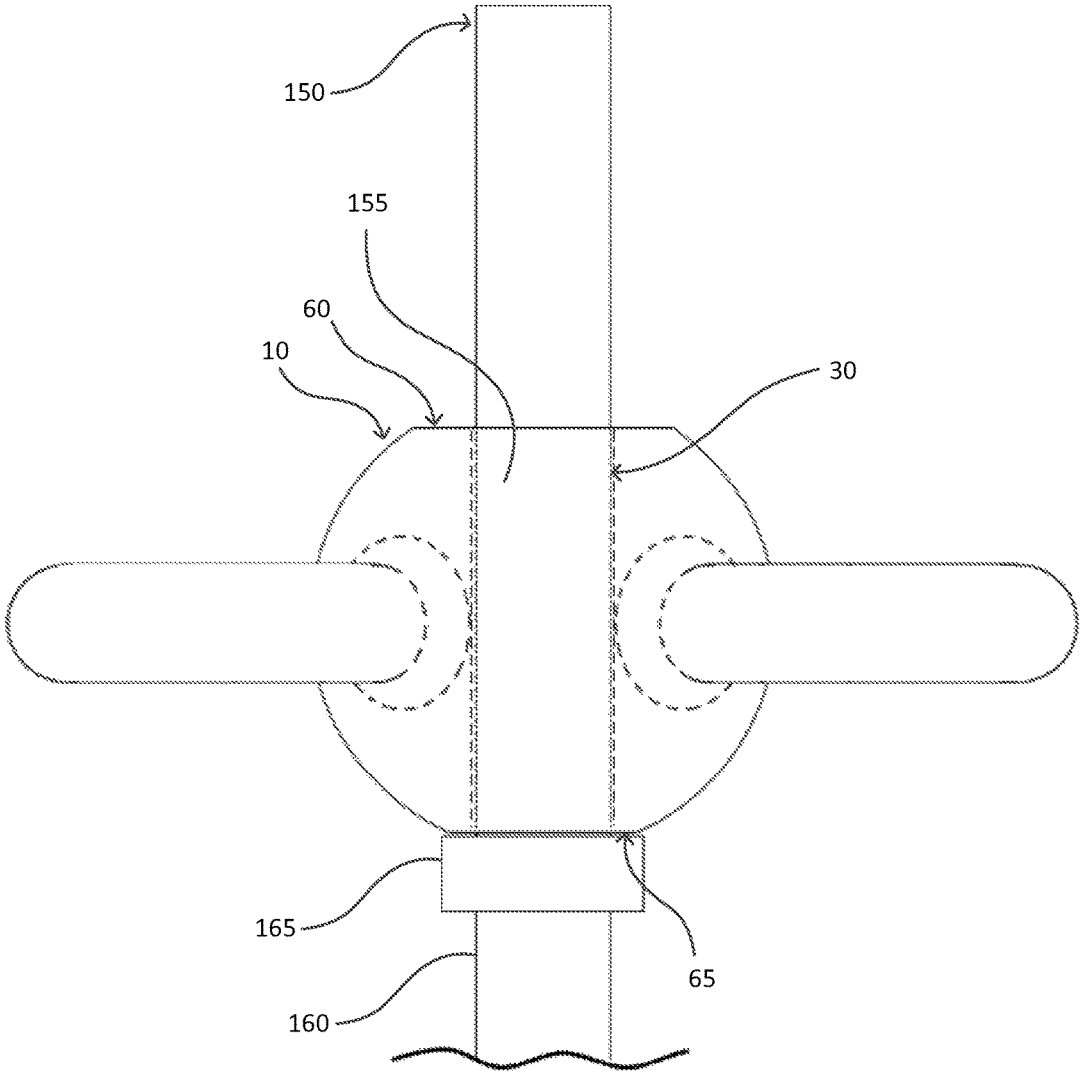
FIG. 7 is an overhead view of the exercise device of FIG. 1 in use with a barbell bar, according to some embodiments.

FIG. 7 is an overhead view of the exercise device 10 showing the exercise device 10 in use with a barbell bar 150, according to some embodiments. In the illustrated embodiment, the barbell bar 150 includes a weight-loading extension 155 for retaining one or more weight plates (not shown), a main bar 160 for handling by a user, and a shoulder 165 between the main bar and the weight-loading extension for preventing any weight plates on the weight-loading extension from sliding onto the main bar (e.g., when tilted).

As shown, the weight-loading extension 155 is positioned horizontally through the cavity 30 of the exercise device 10. The cavity 30 is sized and shaped to fit suitably over the weight-loading extension, for example, in a manner similar to a traditional weight plate (e.g., being slidable along the weight-loading extension while having little lateral movement in other directions). In the position as shown, the shoulder 165 is adjacent to the second surface 65 of the body 15 and the weight-loading extension 155 extends beyond the exercise device 10. As illustrated, the first surface 60 of the body 15 is positioned opposite the second surface 65. In some embodiments, the first surface 60 is configured to enable another exercise device, which may be similar to exercise device 10, to be placed adjacent thereto in a stacked relationship. For example, the second surface 65 of another exercise device may be placed adjacent to the first surface 60 of the exercise device 10. In this manner, one or more exercise devices 10 may be adapted for use similar to traditional weight plates for various exercises, such as a bench press.

Figure 8:
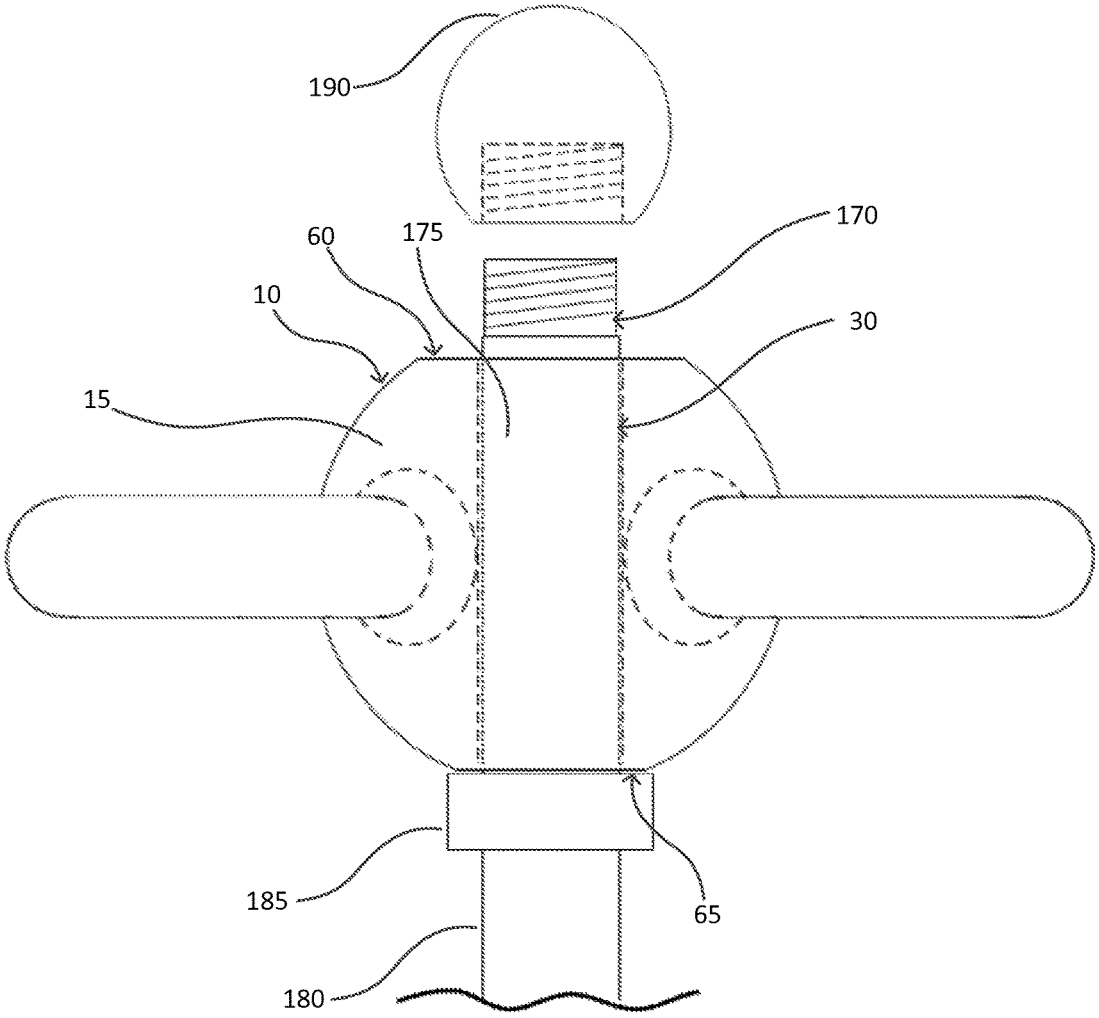
FIG. 8 is an overhead view of the exercise device of FIG. 1 in use with a macebell bar, according to some embodiments.

FIG. 8 is an overhead view of the exercise device 10 showing the exercise device 10 in use with a macebell bar 170, according to some embodiments. In the illustrated embodiment, the macebell bar 170 includes a weight-loading extension 175 for retaining one or more weight plates (not shown), a main bar 180 for handling by a user, a shoulder 185 between the main bar and the weight-loading extension for preventing any weight plates from sliding from the weight-loading extension onto the main bar, and a cap 190 for fastening to the weight-loading extension and preventing any weight plates on the weight-loading extension from sliding off.

As shown, the weight-loading extension 175 is positioned through the cavity 30 of the exercise device 10. The cavity 30 is sized and shaped to fit suitably over the weight-loading extension, for example, in a manner similar to a traditional weight plate (e.g., being slidable along the weight-loading extension while having little lateral movement in other directions). In the position as shown, the shoulder 185 is adjacent to the second surface 65 of the body 15 and the weight-loading extension 175 extends beyond the exercise device 10. As illustrated, the first surface 60 of the body 15 is positioned opposite the second surface 65. In some embodiments, the first surface 60 is configured to be engaged by the cap 190 to secure the exercise device 10 from sliding off of the weight-loading extension 175. In this manner, an exercise device 10 may be adapted to be secured to another piece of exercise equipment, such as a macebell bar 170, to form an assembly (similar to a sledge hammer, axe, hammer, mace, or other similar device) for various exercises, such as gripping the main bar 180 and swinging the macebell bar loaded by the exercise device 10 to improve a swing or grip strength.

Figure 9:
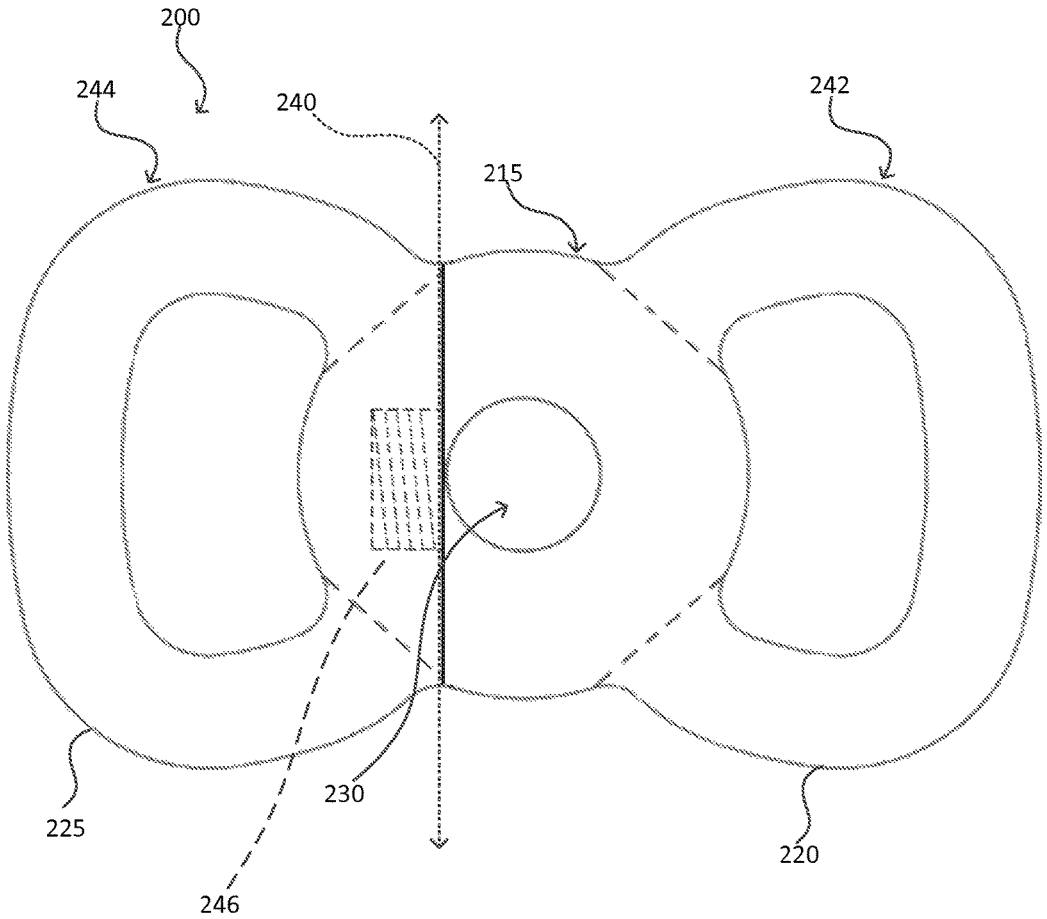
FIG. 9 is an overhead view of another exercise device, according to some embodiments.

FIG. 9 is an overhead view of another exercise device 200, according to some embodiments. The exercise device 200 is similar to the exercise device 10, except that exercise device 200, as shown, is configured to selectively separate into two pieces. In the interest of avoiding a redundant description, the description herein focuses on the differences between the exercise devices 10, 200 and some similar elements between the exercise devices are not described in detail herein.

In the illustrated embodiment, the exercise device 200 includes a body 215, a first handle 220, a second handle 225, and a cavity 230, each of which may be similar to body 15, first handle 20, second handle 25, and cavity 30 in exercise device 10, respectively. However, the exercise device 200 is separable along a plane 240 (generally) and comprises a first portion 242, a second portion 244, and a fastener 246 removably coupling the first portion to the second portion.

As shown, the first portion 242 includes the first handle 220, a portion of the body 215, and the space formed by the cavity 230, and the second portion 244 includes the second handle 225 and another portion of the body 215. The body 215 is generally split into first and second portions 242, 244 by the plane 240. However, as illustrated, a section of the first portion 242 protrudes and is inserted into a space formed in the second portion 244. However, in other embodiments (not shown), a section of the second portion 244 protrudes and is inserted into a space formed in the first portion 242.

In various embodiments, either of the portions 242, 244 may be used individually for exercises in a similar manner to a traditional kettle bell with a single handle.

As illustrated, the fastener 246 is positioned on both the first portion 242 and the second portion 244. The fastener 246 as shown includes threads on the protrusion of the first portion 242 and threads on a recess in the second portion 244 to secure the portions together selectively. However, in other embodiments (not shown), the fastener 246 is a pin-type fastener.

The exercise device 200 with the fastener 246 may be used in various manners and facilitates even more potential exercises. In one example, the fastener 246 secures one of the portions 242, 244 to another piece of exercise equipment, such as a macebell bar 170 (FIG. 8), a hook, a loop, another type of bar, a bar with a lashing, another handle, or an adaptor for another piece of exercise equipment. In another example, the fastener 246 secures one of the portions 242, 244 to a portion of another exercise device having the same or different overall mass, size, shape, handle arrangement, or cavity arrangement, for example.

Figure 10:
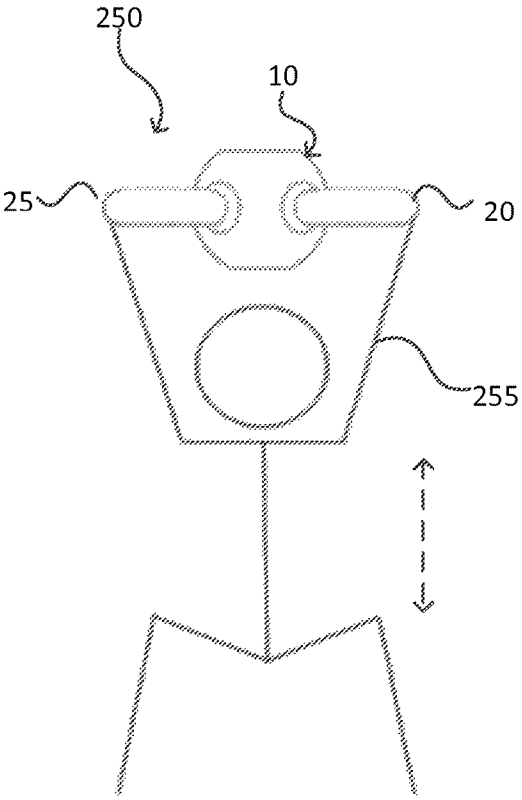

FIG. 10 is a schematic illustration of the exercise device 10 being used in a power squat exercise 250, according to some embodiments. As illustrated in stick figure, a user 255 performs a squatting motion with the exercise device 10 being held in both hands (one on each handle 20, 25). As shown, the exercise device 10 is held in an overhead position to align the mass of the exercise device 10 with the center of mass of the user 255 to work the gluteus muscles, for example.

Figure 11:
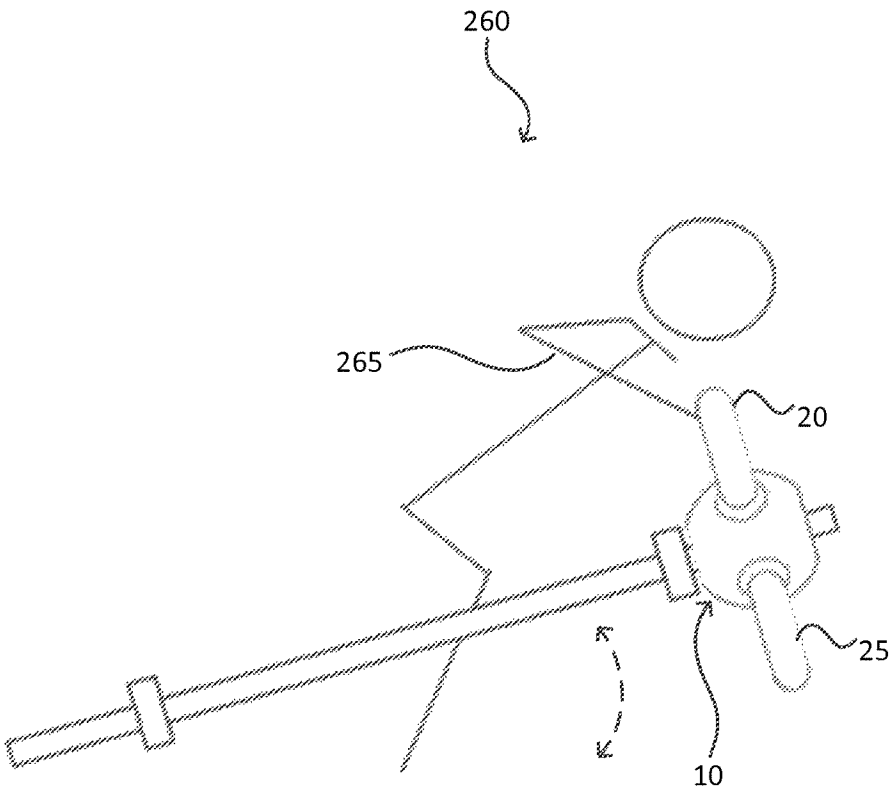
FIGS. 10-13 are schematic illustrations of an exercise device in use with various exercises, according to some embodiments.

FIG. 11 is a schematic illustration of the exercise device 10 being used in a rowing exercise 260, according to some embodiments. As illustrated in stick figure, a user 265 performs a one-armed rowing motion with the exercise device 10 being held by one hand on the first handle 20. As shown, the exercise device 10 has a barbell bar 150 positioned therethrough with the other end of the barbell bar placed on the ground, which facilitates an arcing motion as the user 265 rows with the exercise device 10 to work the trapezius muscles, for example.

Figure 12:
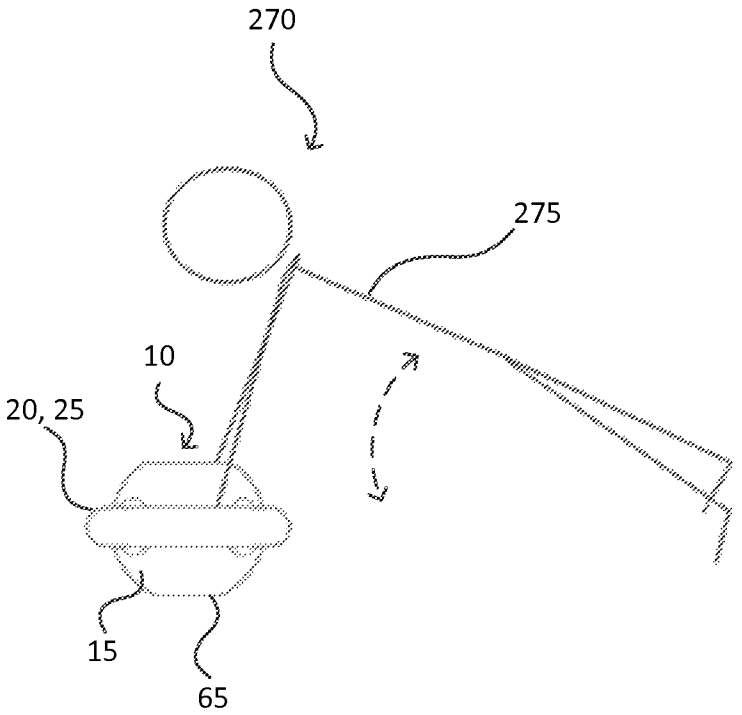

FIG. 12 is a schematic illustration of the exercise device 10 being used in a push-up exercise 270, according to some embodiments. As illustrated in stick figure, the user 275 performs a push-up motion with the exercise device 10 being positioned under the hands (one hand over each handle 20, 25). As shown, the second surface 65 of the exercise device 10 is placed on the ground with the user pushing down on the exercise device 10 to work the pectoral muscles, for example. In the illustrated embodiment, the handles 20, 25 are rigidly attached to the body 15 and are configured to support the weight of the user without moving when used in the push-up exercise 270.

Figure 13:
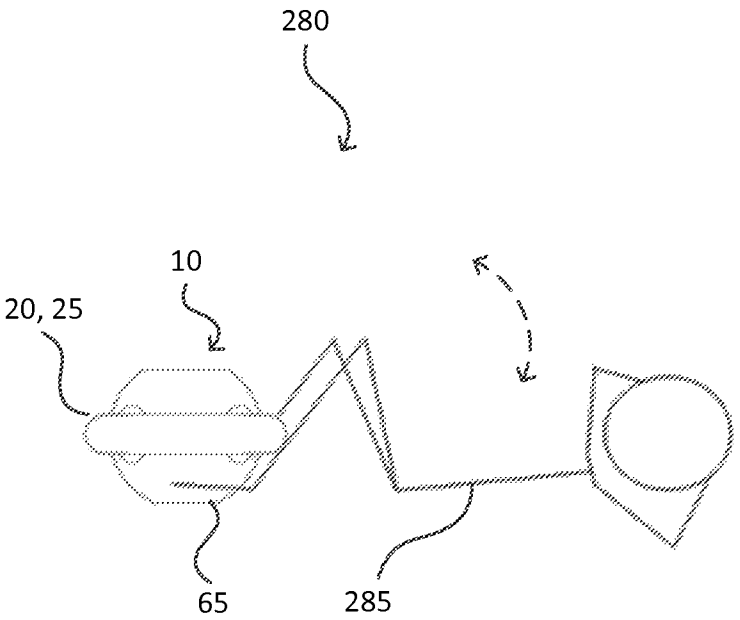

FIG. 13 is a schematic illustration of the exercise device 10 being used in an abdominal exercise 280, according to some embodiments. As illustrated in stick figure, the user 285 performs a sit-up or crunch motion with the exercise device 10 being positioned over the feet (one foot under each handle 20, 25). As shown, the second surface 65 of the exercise device 10 is placed on the ground with the handles 20, 25 providing a resistance for the feet if needed during the sit-up or crunch motion to work the abdominal muscles, for example.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. An exercise device, comprising:

a solid body providing an exercise mass having a first height along an axis, a convex outer surface extending around the axis, and a flat surface configured to engage a ground surface perpendicular to the axis;

a cavity extending through the entire body and the flat surface along the axis;

a rigid first handle having a loop shape for handling by a user extending radially outward from the convex outer surface of the body; and a rigid second handle having a loop shape for handling by the user extending radially outward from the convex outer surface of the body in a direction opposite to the first handle, wherein the first and second handles are aligned along a plane perpendicular to the axis and the first and second handles have a second height along the axis less than the first height of the body to provide a clearance between the ground surface and each of the first and second handles for a user to grip the first and second handles and for the user to position both feet into the clearances when the flat surface of the body is positioned on the ground surface, and wherein each handle has a gripping portion laterally spaced from the convex outer surface of the body and having a cross-sectional diameter that is generally constant along the gripping portion for the user to grip when swinging the body, and wherein each handle has a width at least as wide as the body in the plane.

2. The exercise device of claim 1, wherein the second height is less than about one third of the first height.

3. The exercise device of claim 1, wherein each clearance between the flat surface and the first and second handles is at least 1 inch.

4. The exercise device of claim 1, wherein the second handle extends from the body on an opposite side than the first handle and each handle includes a first section extending radially outward from the body and the gripping portion extends perpendicular to the first section.

5. The exercise device of claim 1, wherein the convex outer surface is in the shape of a sphere.

6. The exercise device of claim 1, wherein at least one of the first and second handles is removably attached to the body.

7. The exercise device of claim 1, wherein the exercise device comprises a first portion including the first handle and a first portion of the body and a second portion including the second handle and a second portion of the body, the first portion removably attached to the second portion.

8. The exercise device of claim 1, wherein the cavity is an elongate, cylindrical shape configured to receive a barbell extending through the cavity.

9. The exercise device of claim 1, wherein the body provides another flat surface, the cavity extending between the flat surfaces of the body.

10. The exercise device of claim 1, wherein the loop shape of each handle has first and second portions extending generally perpendicularly from the convex outer surface of the body and extending non-linearly to connect to the gripping portion.

11. An exercise device, comprising:

a solid body having a first side and a second side providing an exercise mass, a convex outer surface at least partially around the first and second sides defining a height, and a flat surface;

a cavity extending through the entire body and the flat surface;

a barbell extending through the cavity and engaging the flat surface;

a rigid first handle having a loop shape for handling by a user extending radially outward from the convex outer surface on the first side of the body; and a rigid second handle having a loop shape for handling by the user extending radially outward from the convex outer surface on the second side of the body, wherein each handle is aligned in a plane parallel to the flat surface, each handle being spaced apart from the flat surface along the height to provide a clearance between each handle and the flat surface for a user to grip the first and second handles and for the user to position both feet into the clearances, and each handle has a gripping portion laterally spaced from the convex outer surface of the body and having a cross-sectional diameter that is generally constant along the gripping portion for the user to grip when swinging the body, and wherein each handle has a width at least as wide as the body in the plane.

12. The exercise device of claim 11, wherein the body is between the first handle and the second handle.

13. The exercise device of claim 11, wherein the exercise device has an overall length along an axis and at least one of the first and second handles has a first length along the axis being about one third of the overall length.

14. The exercise device of claim 11, wherein the cavity is aligned to an axis perpendicular to the plane.

15. A method, comprising:

providing an exercise device providing an exercise mass, the exercise device including a solid body having a flat surface and a convex outer surface defining a height, a cylindrical cavity extending through the entire body and the flat surface, a rigid first handle having a loop shape extending radially outward from the convex outer surface of the body, and a rigid second handle having a loop shape extending radially outward from the body, wherein:

each handle is aligned in a plane parallel to the flat surface, each handle being spaced apart from the flat surface along the height to provide a clearance between each handle and the flat surface for a user to grip the first and second handles and for the user to position both feet into the clearances, and each handle has a gripping portion laterally spaced from the convex outer surface of the body and having a cross-sectional diameter that is generally constant along the gripping portion for the user to grip when swinging the body, and each handle has a width at least as wide as the body in the plane;

sliding a barbell through the cavity of the exercise device, the flat surface engaging the barbell;

gripping at least one of the first and second handles; and moving the exercise device and the barbell to perform an exercise with the weight provided by the barbell and the exercise device.

16. The method of claim 15, further comprising gripping at least one of the first and second handles to move the exercise device.

17. The method of claim 15, wherein the cavity is aligned to an axis perpendicular to the plane.

18. The method of claim 15, further comprising separating the exercise device into a first portion having the first handle and a second portion having the second handle, wherein the exercise device is formed of a first portion including the first handle and a first portion of the body and a second portion including the second handle and a second portion of the body, the second portion being removably attached to the first portion.

19. The method of claim 15, further comprising attaching a cap to the barbell to restrict movement of the body with respect to the barbell in at least one direction.

20. The method of claim 15, further comprising sliding another exercise device onto the barbell.

* * * * *